United States Patent [19]

Novinger

[11] Patent Number: 4,654,927

[45] Date of Patent: Apr. 7, 1987

[54] SIDE SWEEPING BRUSHING VACUUM MACHINE

[76] Inventor: Harry E. Novinger, 4961 S. Chester St., Englewood, Colo. 80111

[21] Appl. No.: 678,346

[22] Filed: Dec. 5, 1984

[51] Int. Cl.[4] ..... A47L 5/28

[52] U.S. Cl. ..... 15/340; 15/49 C; 15/384

[58] Field of Search ..... 15/384, 340, 50 C, 49 C

[56] References Cited

U.S. PATENT DOCUMENTS

| | | | |
|---|---|---|---|
| 2,941,232 | 6/1960 | Milbourne | 15/384 X |
| 3,220,043 | 11/1965 | Lampe | 15/384 X |
| 3,624,861 | 12/1971 | Freiheit | 15/340 X |
| 4,499,624 | 2/1985 | Bloome et al. | 15/50 C X |

FOREIGN PATENT DOCUMENTS

| | | | |
|---|---|---|---|
| 838088 | 5/1952 | Fed. Rep. of Germany | 15/384 |

*Primary Examiner*—Chris K. Moore

[57] ABSTRACT

Semi-automatic self-propelled side sweeping mode of operation is provided by any of three forms of rotating members supporting and propelling a nozzle body over a work surface. Two of these members are designed as load bearing brush rolls while cleaning or polishing, one is a smooth cylinder and brush, the other is a dense brush-covered roll. These nozzle propelling members are arranged as pairs in tandem or in dual to their direction of travel over a work surface. The third form may operate in additional modes. Its propelling members comprise at least one pair of wheels. Each wheel is coaxial to a brush roll and may rotate with the brush roll or may free-wheel until clutched to rotate with the brush roll through linkage responsive to operator urging.

An elongated handle is on the nozzle pointed in substantially the same direction as the nozzle propelling members. Operator urging of the handle, in a twisting action, will tilt the nozzle to increase the friction of one propelling member over that of the other on the work surface. This results in nozzle travel in the direction of rotation of the propelling member, in circular sweeps about the operator. Urging of the handle by twisting also may increase the speed of rotation of one nozzle propelling member by variable electrical switch to effect side sweeps in two directions when each propelling member is individually driven by an electrical motor.

14 Claims, 17 Drawing Figures

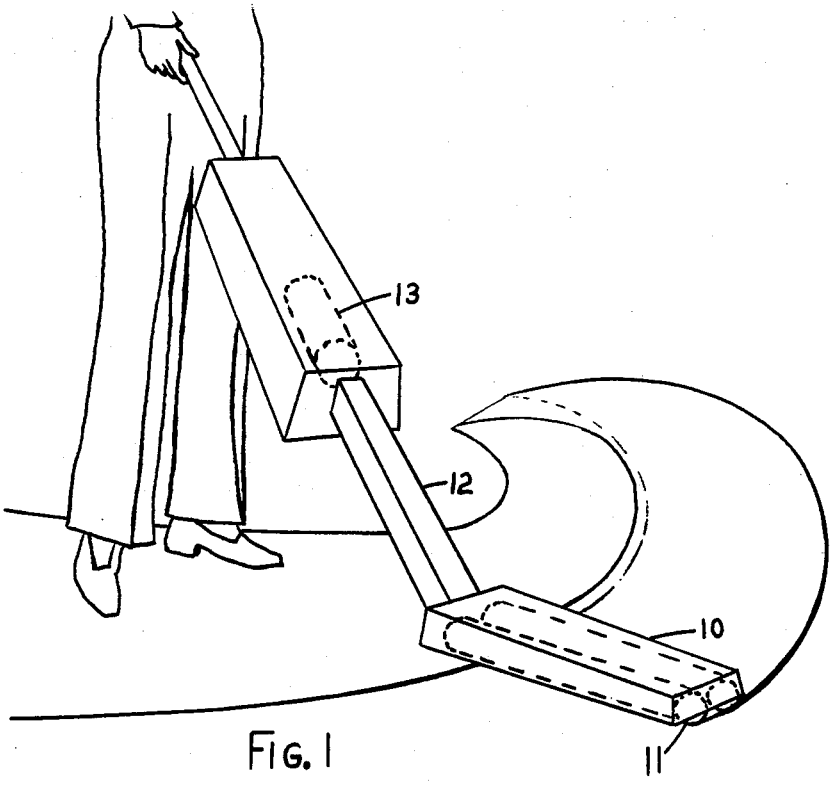
FIG. 1
FIG. 14
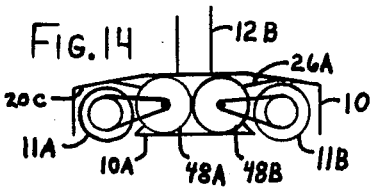
FIG. 12
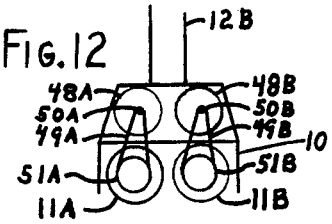
FIG. 13
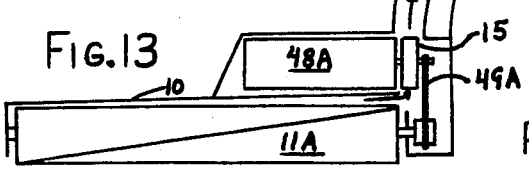
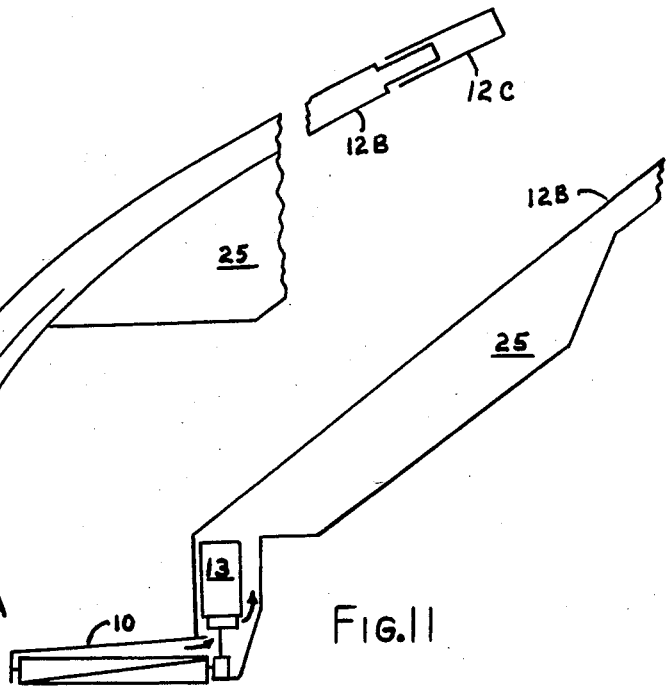
FIG. 11

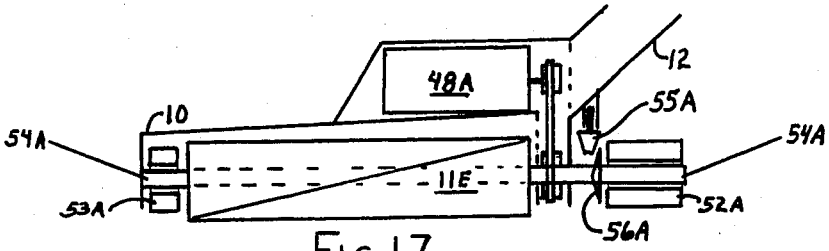
FIG. 17
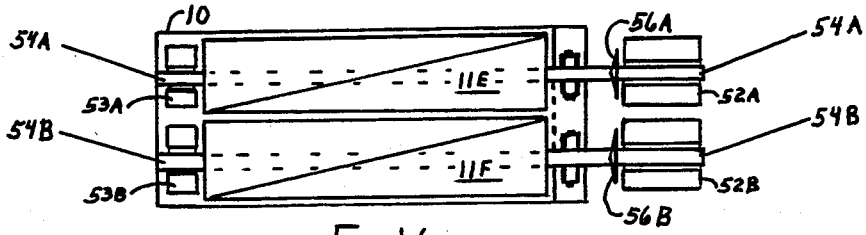
FIG. 16
FIG. 6
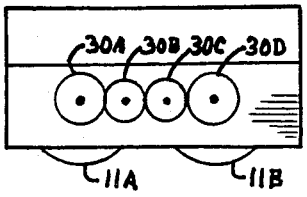
FIG. 7
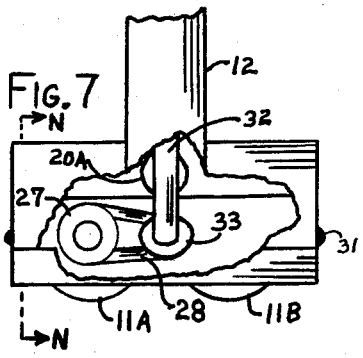
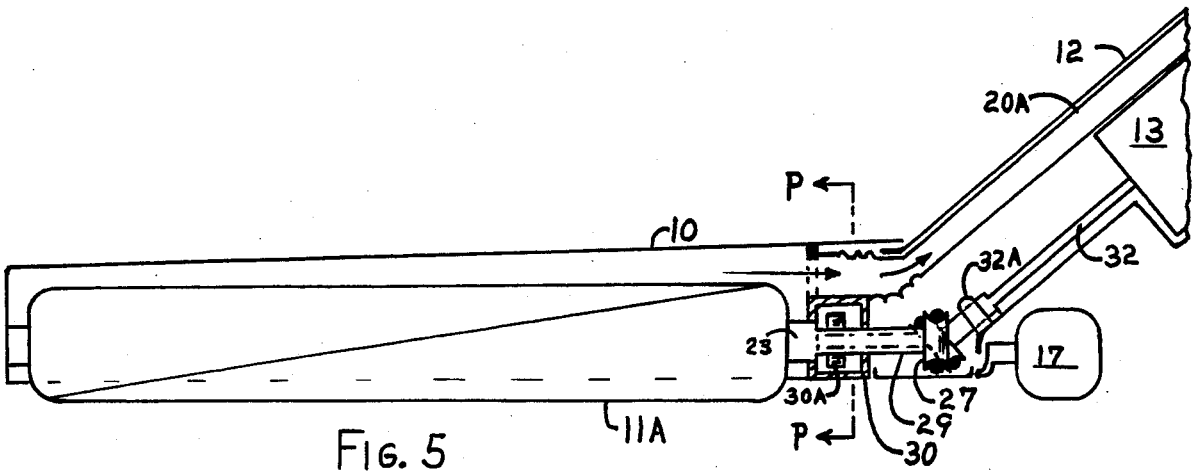
FIG. 5

SIDE SWEEPING BRUSHING VACUUM MACHINE

BACKGROUND OF THE INVENTION

This invention relates to brush vacuum cleaning and brush polishing apparatus comprising two brush rolls in a nozzle housing arranged with parallel axes in tandem or in dual in respect to the path of motion over a work surface, normally a floor. An elongated handle controls the nozzle. The handle is substantially pointed in the same direction of the brush rolls. Nozzle and brush roll path motions are substantially perpendicular to the nozzle, rolls and handle; but, is modified by operator holding of the long handle causing a circular nozzle side sweep about the operator. The nozzle is propelled by at least two nozzle weight supporting brush rolls of special design or by at least two nozzle weight supporting wheels driven through clutch or locked to turn with the rolls by the same power source as the brush rolls. The two nozzle propelling members rotate in opposite directions. Their friction on a work surface is made differential by operator urging of the handle. The member under greater friction propels the nozzle. Motors for power are mounted on the nozzle or may be mounted on the handle by use of rigid or flexible remoting power shafts.

DESCRIPTION OF PRIOR ART

Twin brush rolls in tandem are well known in the art. Twin brush rolls in dual were not found. Several machines with horizontal roll axes in tandem, have elongated handles on their nozzles or housings for floor or wall use, but their handles are mounted parallel to their paths of motion on their work surfaces unlike the handle of the instant invention being perpendicular to the path of motion.

Power drive systems for counter rotation of two brush rolls are widely known when driven by one motor. The first test model leading to this invention used a kitchen mixer worm gear transmission driving miniature brush rolls adaptable to the invention. Lex, in U.S. Pat. No. 4,419,784 discloses such a transmission but unsuitable handle for floor use on the nozzle. Young, in U.S. Pat. No. 1,596,041 shows a drive which is adaptable for counter rotation of tandem rolls. A suitable transmission for two rolls in-dual arrangement was not found in the art.

Freiheit, in U.S. Pat. No. 3,624,861 does use counter rotating rolls and a handle to "shift the weight of the device from one to the other of the brushes, thus tending to move the machine rearwardly or forewardly". He does not suggest his rolls are designed for the purpose of supporting the weight of his nozzle while also propelling the nozzle as characteristic of the rolls of the present invention. Further, his handle does shift the weight much as does the instant invention but he does not so much as hint orienting his handle perpendicular to its path of motion and to that of the rolls as in the instant invention. Novinger, in U.S. Pat. No. 4,430,768 provides for deep set brush bristles and miniaturization of brush rolls adaptable to the present invention. None of the art was found to suggest the present invention's nozzle supporting and propelling characteristics of the present invention's brush rolls which in one form have rounded cylinder ends and smooth cylinder surfaces for easy spinning over soft work surfaces; and, in another form, has brush bristles dense enough or stiff enough to support the nozzle and to propel it for scrubbing and polishing.

None of the art suggests structure for lateral nozzle sweeps, relative the operator, which facilitates: fast work production rates resulting from controlled sweep speeds over large or small areas with few operator steps, a versatile nozzle shape allowing access under and about furniture without use of special attachments, and an easy and pleasant experience derived from semi-automatic built in self-propelled side sweeps.

BRIEF SUMMARY OF INVENTION

The present invention comprehends a side sweeping mode of operation in floor type brush vacuum cleaning and brush scrubbing and brush polishing apparatus comprising twin brush rolls disposed in a nozzle housing with axes parallel and usually horizontal and arranged in tandem or in dual in respect to the path of motion over a work surface, normally a floor.

An elongated handle is on the nozzle housing the two brush rolls. The handle is pointed in substantially the same direction as the axes of the two brush rolls because the center of the handle lies in a plane perpendicular to the work surface and substantially parallel to the axis of each brush roll.

The path of motion of the brush rolls, the nozzle and the handle is in lateral circular side sweeps of any length about the operator. The motion is self-propelled by nozzle propelling members.

The nozzle propelling members maybe of two forms of brush rolls. Both forms are designed to support the weight of the nozzle and to drive the nozzle and while doing so, also act as cleaning or polishing members. Nozzle propelling members also may include a form of wheel coaxial to the brush roll in the nozzle and driven by the same power source driving the coaxial brush roll. This wheel may be locked to rotate whenever the brush roll rotates or may free-wheel until clutched to rotate with the brush roll. Both forms are responsive to operator urging of the elongated handle.

The nozzle propelling members are rotatably fixed to the nozzle. They rotate in opposite directions and those on one side of the nozzle provide propelling traction at any one time and in one direction being responsive to handle twist or rotation by the operator. The side having the greater friction on the work surface is the side providing semiautomatic self-propulsion of the nozzle in side sweeps.

The nozzle propelling members are driven by one or more electric motors mounted on the nozzle or mounted on the handle. When on the handle, the motor or motors powers the nozzle propelling members by rigid or flexible shaft. In most of the embodiments, only one propelling member is located on each side of the nozzle. However, in one form when the brush roll is employed only to brush and the nozzle propelling member is wheel type, there may be two on each side of the nozzle. In the forms of the invention wherein the handle is hinged, one or two supporting wheels, not of the propelling type, are preferred to support the rear of the nozzle, and in forms, may be used at the front of the nozzle to advantage.

The brush rolls, and in other forms, the brush rolls and the wheel propelling members may rotate no faster than half the speed of those machines in the prior art having only one brush roll. This is because there are two opposing brush rolls in the present invention and both clean substantially equally well unless the side sweeps are made at faster than designed speeds.

The sweep speed is dependent on the amount of urging of the handle. In the form of the invention wherein the friction of the nozzle propelling members is responsive to twisting of handle for tilting the nozzle to place a greater weight on one side, the greater the urging, the greater the tilt and the greater the sweep speed. Both propelling members rotate at the same speed when being driven by one motor. In the forms wherein the nozzle propelling members are individually driven by separate motors, the variable electrical switch may be designed for similar amounts of handle urging so as to speed up one motor, slow one or combination thereof; or without the switch, the handle can be urged to provide tilt of the nozzle to induce the friction. In all embodiments of the invention, the nozzles propelling members are responsive to natural operator hand urging in at least one form and in some more than one in the selection of short, long, slow or fast sweeps.

The brush rolls designed for nozzle propelling have special characteristics to not abrade soft floor surfaces as will be seen. One type of brush roll, not used as a nozzle propelling member because it is coaxial with a wheel type nozzle propelling member, may be a conventional brush roll from the prior art.

The elongated, low profile nozzle is advantageously adapted for operator use of only one arm in the lateral sweeps relative the operator. The nozzle is narrow for easy entry between objects by manual push and pull. The need to push and pull is infrequenct but when required, is also easily performed with only one operator arm. The powered rotation of the propelling members combined with their rounded cylindrical ends, and being aligned with the handle and the operator's arm, allow easy movements in all directions across the work surface.

Another object is to provide apparatus not subject to the disadvantages outlined above for the prior art. Still another and a preferred object is to provide structure for improved utility over the assemblages, bulky and difficult to use machines of the prior art, while providing for a faster and a more enjoyable experience to the operator.

BRIEF DESCRIPTION OF DRAWINGS

Other features and advantages of the invention will be apparent from the following description taken in connection with the following specification and accompanying drawings wherein:

FIG. 1 is a perspective view of the self propelled side sweeping apparatus on a work surface. It includes a fragmentary view of a general embodiment of the invention for illustrating directional arrangements of handle to nozzle, to nozzle propelling members and to direction of nozzle movement.

FIG. 5 is a similar drawing of a side view of the same nozzle propelling member as in FIG. 2, but combining alternative transmission and power members adapted to location on the handle, and associated power remoting members.

FIG. 6 is a similar drawings and partly diagrammatic of the rear end of FIG. 5 taken along line P—P of FIG. 5.

FIG. 7 is a similar drawing of a rear view of FIG. 5 and partly broken away to show the belt drive.

FIG. 11 is a schematic side view of an alternative form of handle and motor arrangements of apparatus with a mode of operation of that of FIG. 2.

FIG. 12 is schematic rear view of an alternative form of the structure of FIG. 4 with twin motors above the nozzle.

FIG. 13 is a schematic side view of the structure of FIG. 12.

FIG. 14 is a schematic end view of an alternative form of the structure of FIG. 12 with the twin motors mounted in the nozzle between the nozzle propelling members.

FIG. 16 is a schematic bottom view of an alternative wheel type of nozzle propelling member to the foregoing brush roll type nozzle propelling members.

FIG. 17 is a schematic side view of the structure of FIG. 16.

DETAILED DESCRIPTION OF THE PREFERRED EMBODIMENTS

Figure 4:
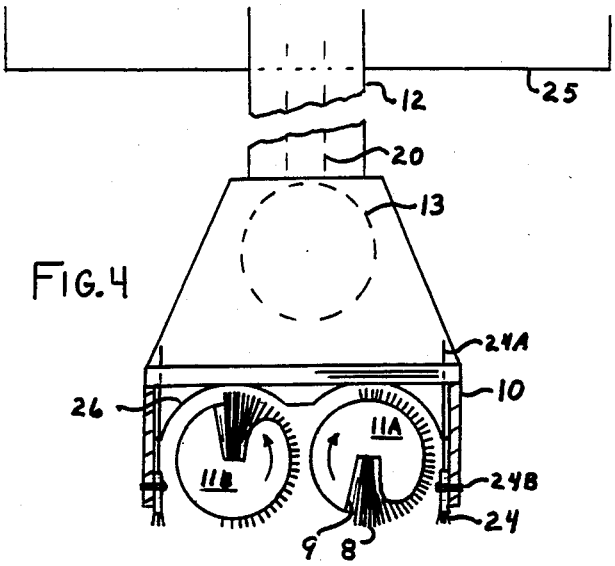
FIG. 4 is a similar drawing of a front view of the structure in FIG. 2, particularly directed to the structure of the twin load bearing brush roll type nozzle propelling members in tandem taken along line M—M in FIG. 2.

In the exemplary embodiment of the invention disclosed in FIG. 1 of the drawings, only major members are illustrated in a general structure of a new mode of operation. The main purpose is to illustrate the novel nozzle shape in its side sweeping movements on a work surface about the operator. The illustration is also to show the directional arrangements of the handle to the nozzle, or the nozzle to the propelling members which also support the weight of the mozzle and the weight imposed upon the nozzle, and the direction of these members to their direction of movement.

The major members are generally designated as follows; the nozzle 10, the two counter or opposite rotating combined nozzle propelling members and brush rolls 11, the elongated handle 12 and power source motor 13.

Brush rolls 11 are arranged with their axis parallel and in tandem with respect to their direction of side sweeping movement over the work surface. Brush rolls 11 also support the weight of nozzle 10 and, in this embodiment, do a double job by also propelling the nozzle.

Handle 12 is fixed on nozzle 10 here because nozzle 10 has no rear support wheel as normally required when the handle is hinged for movement relative nozzle 10. Handle 12 carries a debris duct and container, and electric motor 13. Motor 13 drives a suction pump and drives nozzle propel brush rolls 11 by remote fixed or flexible shafts. Reduction or step-down and counter-rotating transmissions are involved as will be seen.

In this embodiment, the operator twists the handle, usually less than 4 degrees rotation, in the selected direction of sweep. This tilts nozzle 10 placing greater weight on the lower side nozzle propelling member 11. The greater the differential friction of the lower nozzle propelling member 11 on the work surface to that of its twin, the faster the nozzle sweeps in the selected direction. The operator urges handle 12 back to neutral or horizontal or equal friction of the nozzle propel members to stop the sweep. In all the embodiments, of this invention, the nozzle propelling members are responsive to the same natural urgings of the handle in making semi-automatic side sweeps and some embodiments provide additional means of response as will be seen.

Figure 3:
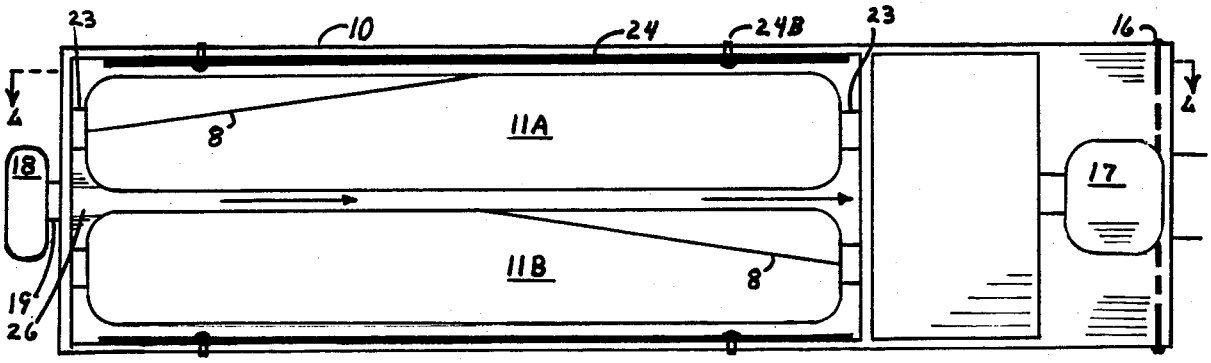
FIG. 3 is a similar drawing of the bottom of the structure of FIG. 2.
Figure 2:
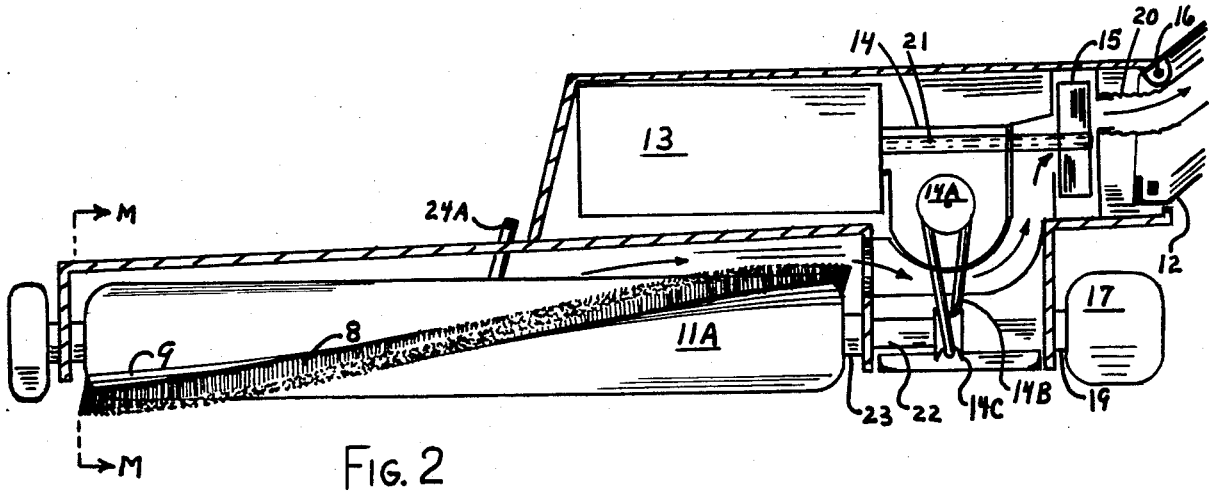
FIG. 2 is a longitudinal side view of a load bearing and brush roll type nozzle propelling member and certain associated elements taken along line L—L in FIG. 3. The illustration is partly in section, partly in perspective, and fragmentary where clarity and conventional elements allow simplicity.

More specifically, referring now to FIGS. 2, 3 and 4, the invention comprehends the use of such a side sweeper in the form of a vacuum cleaner much like FIG. 1 but with the motor 13 on nozzle 10. This still allows a low profile front nozzle portion for entry under low set objects.

The same two brush rolls 11 are also designed with load bearing characteristics and not only brush clean but also propel nozzle 10 in side sweeps as nozzle propelling members 11. They are provided with smooth cylindrical surfaces, and rounded cylindrical ends. The smooth surfaces including the shoulder are low friction type or treated so as to allow constant rotation on carpeting and on other soft work surfaces with minimal friction during side sweeps. Short push-pull movements, in directions parallel to their axes as may be necessary to enter confined areas, are also allowed to be easily made manually. Movements in all directions are made very easily. The side sweeps are semi-automatic. The occasional push and pull is in line with the operator's arm and rotating of the propelling members makes the movements easier when rotating than when not rotating.

Referring to FIG. 4, at least one brush bristle strip 8 is deep set and fixed in cavity 9 in each roll 11 on a helical angle of about 20 degrees. Cavity 9 has a side and shoulder leading the brush in rotation and a side and shoulder following when of a gentle helical preferred shape. The shoulder following the brush must be well rounded to not abrade the pile of carpeting. Cavity 9 may be a cone with a group of bristles deeply set and fixed therein. When a cone, multiple cones are required and their following shoulders are well rounded.

Brush strip 8 maybe a strip having conventional characteristics. Tests show the bristles should be at least one half inch in length and extend about one eight inch beyond the roll 11 cylinder for optional cleaning and suitable traction for self propulsion. The shoulder following is located close behind the strip and this rounded shoulder is curved away from the strip to also allow the bristles to flex by work surface friction and completely wrap upon the shoulder with few, if any, of the bristle ends extending beyond the surface of rolls 11. The bristles are substantially perpendicular to the roll axis.

When the operator urges handle 12 to the left for example, nozzle 10 tilts causing nozzle propelling member 11A to bear more load than member 11B. The greater the differential load of 11A to 11B, the greater the friction and the faster the nozzle sweep. This embodiment drives both propelling members 11 at the same speed. The speed need not be quite 50% of the speed of brush rolls in dual as will be seen in FIG. 9 because both brush rolls 11 traverse the same swath, cleaning while propelling, at the same speed as when not sweeping. The test further showed when the bristles were extended more than one eighth inch beyond the cylinder of brush rolls 11, the friction and the speed of sweep increased. When the additional brush strips were installed, the change from neutral to sweep was more abrupt. Stiffened bristles further increased the friction. The wider the cavity, the greater the friction. A wide cavity with no brush cleans better than conventional nozzles without powered rolls apparently because of the carpet vibration.

The width of cavity 9 should correspond to the diameter and length roll 11 and the weight of nozzle 10. In tests, the foot print pressure of rolls under one inch diameter and 11¾ inches long made swaths almost aidentical to those under the same load, length and 2.5 inches diameter. The ability to pick up dry cement and sand mix was better for the smaller diameter until a baffle was installed between the bigger rolls. The baffle in the much wider set rolls 11 in FIG. 14 is similar but wider than the one used in FIG. 4 in the tests. The 11¾ inch length brush rolls were chosen as the test comparison length. Earlier, six inch rolls were used which did not allow a long enough low profile nozzle reach with the nose of the nozzle when the motors were placed on the nozzle as in FIG. 13. The six inch roll cleaned the test area in less than half the time of the conventional and widely used 11¾ inch roll used in the comparison machine.

An alternative combined brush roll type propelling member is not shown because it has a conventional brush roll appearance much like some made except for many more bristles than is conventionally used. It evolved from the foregoing tests of increasing the friction when the one brush roll shown in FIG. 2 received six brush strips. The dense mass of bristles did not let the cylinder reach the carpet surface. The friction was so great it can be used only on hard surfaces as a scrubber and as a polisher but still function also as a nozzle propelling member with horizontal axis.

FIG. 2 further illustrates the arrangements of a conventional motor 13, combination reduction gear and belt transmissions 14, suction pump 15 and two brush rolls 11 performing also as nozzle support and propelling members 11. The one conventional motor 13 is able to power both rolls and power a suction pump because the rolls rotate approximately half the speed as in single roll machines and because of the light weight structure. The smooth surfaces of rolls 11, to the operator's hand, have less friction when rotating than when not rotating; apparently due to brush resistance in the static posture.

Brush 8 and shoulders 9 are shown only as lines in FIG. 3 for simplicity. The elongated handle 12 is long enough for a standing operator. The center line of the handle is preferred to lie in a vertical plane which is parallel to the axes of the two nozzle propelling members 11, defined as 11A and 11B in FIGS. 2, 3 and 4. Handle 12 is hinge fixed to nozzle 10 with bolt 16 for raising and lowering the hand grip end as may be desired.

Rear supporting wheel 17 is required when handle 12 is hinged, the nozzle now is not balanced as by a fixed handle. Front supporting wheel 18 may be provided when desired but diminishes the ability of nozzle 10 to sweep and clean under wall mounted heaters and the like. If used, it may be much smaller in width. These wheels are also rounded for the short push and pull movements occasionally required. Further tests may show a need for use of the wheel nozzle propelling members 52A and 52B as in FIG. 16 to supplement nozzle propelling members 11A and 11B in FIG. 2 because propelling members 52 free wheel until selectively powered as nozzle propelling members. Wheels 17 and 18 are rotatably fixed to nozzle 10 by bearings 19 in any conventional manner. Conventional omni-directional wheels or rollers were tested but the design on hand was not acceptable, but others may be desirable.

Arrows show the general debris flow path defined by conventional nozzle and handle duct 20. Duct 20 is flexible adjacent hinge bolt 16 and carries debris from the work surface, through the nozzle to debris container 25 located on handle 12 or any conventional position. Suction pump 15 is driven by shaft 21, which is driven by transmission 14, which is driven by motor 13. Transmission 14 drives nozzle propelling members 11 through pulleys and belt 14A, B and C and shaft 22. It is a conventional type transmission similar to Lex as earlier cited. Such transmissions wherein one motor drives two shafts for counter rotation abound as in the kitchen food mixer and as by Young above cited. Conventional type roll bearing 23 rotatably fixes and connects members 11 to nozzle 10 and shaft 22.

The low profile of the nose portion of nozzle 10 is illustrated by FIG. 2. The nozzle may be miniature or jumbo size depending on the nozzle propelling members 11 size. The tests suggest all sizes clean equally well on long and short carpet piles because the bristles of the propelling members 11 can fully bend on the roll shoulder causing only slightly more resistance on short pile as on long pile carpeting. The brushes on rolls 11 reach all pile lengths equally; thus, do not require adjustments even on irregular length bristles.

FIG. 3 illustrates the general dimensions of nozzle margin brush strip 24. These brush strips 24 brush close to furniture and walls where the path of rotating roll brush 8 doesn't reach. This is easily seen in FIG. 4. Brush strips 24 may be adjusted in height by conventional types of bias slots and rivits 24B and brush adjusting handle 24A. Nozzle 10 maybe tilted more than 5 degrees for rapid sweeping, this adjustment of brush strips 24 allows greater than normal sweep speeds but less side edge cleaning at the end of sweeps where the nose of the nozzle cannot be used. Roll brush 8 brushes substantially even with the nose portion of nozzle 10. A thin rubber strip may be substituted for brush 24 in certain operations.

FIG. 4 better shows debris nozzle duct baffle 26. This portion of duct 20 forms the upper duct wall in the nozzle for optimal distribution of suction over the length of the nozzle as seen in FIG. 2 at 26.

FIGS. 5, 6, 7 and 8 illustrate two embodiments wherein power is remoted as characterised by FIG. 1. Most of the members in FIGS. 2, 3 and 4 are used here although power member 13 is located on handle 12. Remoting the power allows a lower nozzle profile for reaching under furniture. It requires use of rigid or flexible shafts of a few inches in length. A very short length of about two inches is shown in a third embodiment in FIG. 11.

Motor 13 drives rigid shaft 32 which is rotatably fixed for support to handle 12 by bearing 32A. Pulley 33 is on shaft 32 as better seen in FIG. 7. Belt 28 drives pulley 27 for a reduction in motor speed when designed here rather than at motor 13. Pulley 27 drives its shaft 29 which, through bearing 23, drives brush roll 11A also performing as nozzle propelling member 11A. Gear transmission 30 may be any conventional gear or belt transmission designed for the purpose of rotating the other twin roll 11B at the same speed but in opposite direction to 11A. This is better illustrated, in gear form, in FIG. 6; wherein, 30A, B, C and D are in mesh, with 30A and 30D driving their respective rolls 11. Conventional means support the four gears in transmission and housing 30.

Handle 12 is hinge fixed to nozzle 10 by bolt 31 as in FIG. 7. Debris duct 20A is made flexible adjacent to the hinged area. Nozzle support wheel 17 is mounted as in FIG. 2 to distribute the weight of handle 12. This wheel 17 is not necessary should handle 12 be rigidly fixed to nozzle 10.

Figure 8:
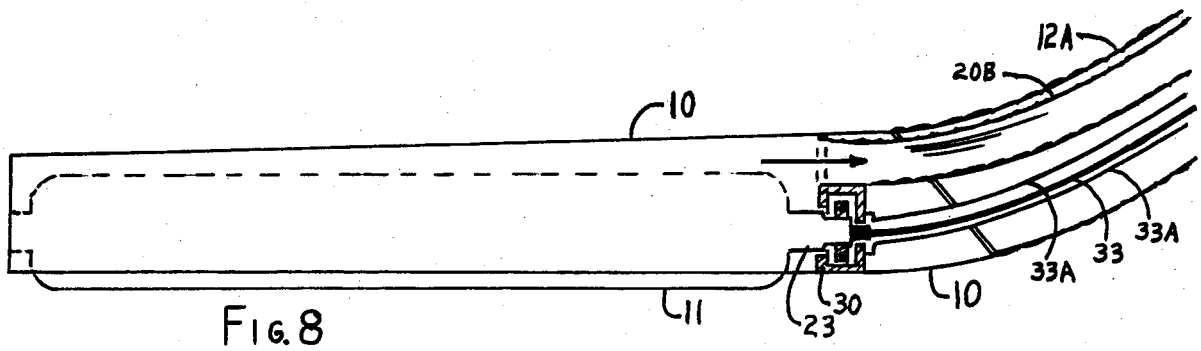
FIG. 8 is a similar drawing of an alternative form of remoting power by flexible shaft compared to the rigid shaft of FIG. 5.

As in FIG. 2, the remoting power structures of FIGS. 5 and 8 may, with a change to brush rolls 11 having a smaller diameter cylinder so as to not be of load bearing design, be connected to the wheel type nozzle propelling member structure of FIGS. 16 and 17.

FIG. 8, more specifically, is a second remoting power embodiment of the invention. Remote power shaft 33 is a conventional designed flexible shaft. Oil cover 33A protects and braces shaft 33. This is substantially the main difference between the structure of FIG. 8 and FIG. 5. Handle 12A carries debris duct 20B; both may be made flexible. A bent rod rotatable up to at least 180 degrees may be fixed for rotation on such a flexible handle for temporary holding of the nozzle in various oblique positions as desired. Transmission 30 is driven by shaft 33. This structure is adaptable to two small motors mounted on handle 12A, whereby each motor drives individual flexible shaft 33 which drives individual brush roll 11 also performing as nozzle propel member 11. These embodiments provide simple, light weight and semi-automatic self propelled vacuum cleaners. They are adaptable in other forms of structures of the invention where remote power is desired. Within the structures of FIGS. 5 and 8, the remote power shafts may be located in debris ducts 20A, when 20A may serve as handle 12 and 12A.

Figure 10:
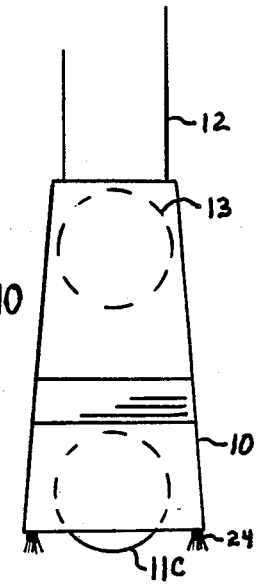
FIG. 10 is a schematic and partly diagrammatic drawing of the front view of FIG. 9.
Figure 9:
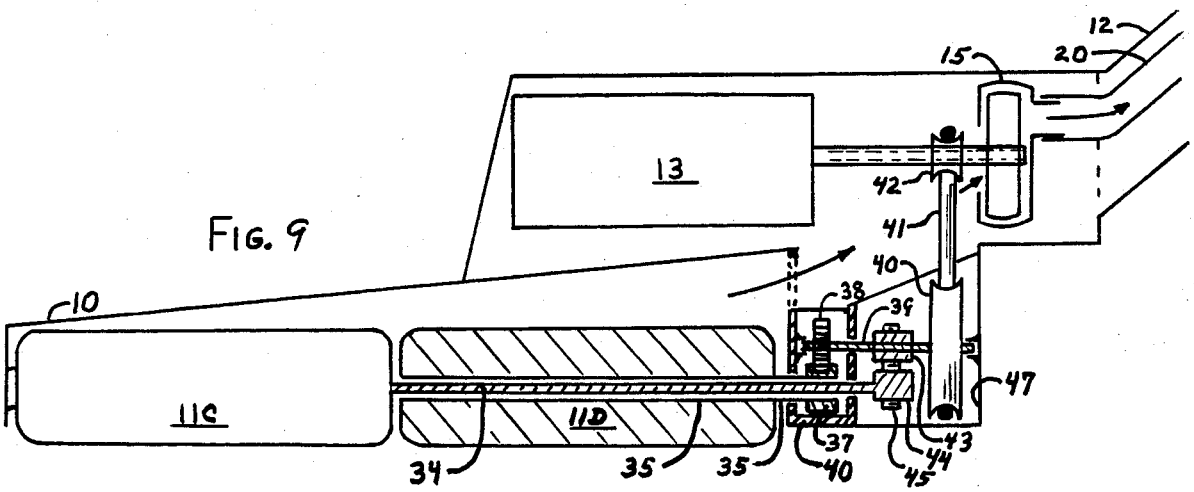
FIG. 9 is a longitudinal view of the load bearing nozzle propelling brush rolls of FIG. 2, but here in dual instead of in tandem as in FIG. 2. The drawing is partly in section and the more conventional members partly in perspective or fragmentary clarity.

FIGS. 9 and 10 illustrate the in dual form of this invention with brush rolls 11 as brush roll 11C and 11D because they have structures differently from those in FIG. 2 only by their drive shafts 34 and 35. These brush rolls 11 also perform as nozzle 10 propelling members 11C and 11D; as such, they also rotate in opposite directions. Its mode of operation provides the same side sweeps because the nozzle propelling members 11 are also responsive to handle 12 urging by twisting. Propelling member 11D is in section to show the method for driving its twin 11C and for clarity when viewing a different form in FIG. 15. Shaft 34 extends through shaft 35 to fix and drive 11C. Shaft 35 is fixed to drive 11D.

Motor 13 may be placed as shown or removed entirely from above nozzle 10 and carried on handle 12. It may continue to have its splined shaft 21 fitted with suction pump 15 and pully 42. Pully 42 would remain as here illustrated to drive belt 41 which drives the bigger pully 40 for speed reduction. Pully 40 drives shaft 39 which has pulley 43 and gear 38 mounted for driving. Gear 38 drives gear 37 which is on shaft 35. Shaft 34 extends into the belt transmission housing 47 to mount flat belt pully 44 under pully 43 and for both pulleys to be driven by flat belt 45. Thus, nozzle propelling members 11C and 11D are rotated in opposite directions. Gear transmission 46 is sealed about 37 and 38 in a conventional manner. Both members 11 are rotated at the same speed.

In operation, when handle 12 is twisted out of neutral to the left, for example, nozzle propelling members 11C has more weight placed on it because propelling member 11D is lifted decreasing its pressure on the work surface and its traction friction and a sweep to the left commences. For a natural left sweep by a natural roll of the operator's hand on handle 12, 11C must rotate in direction for a left sweep. Handle 12 is normally fixed in a rigid manner to nozzle 10 at about 45 degrees to the axis of the two propelling members 11 to form a triangle having two of its points on the work surface. One at the nozzle toe at the front of 11C and the other point at the heel of the nozzle at the rear of 11D and the third point is at the handle grip. When this triangle is vertical to the work surface, a twist to the left will place pressure on 11C and a twist to the right out of vertical will also place pressure on 11C, both twists resulting in a left sweep in this form of structure which is in dual arrangement of the nozzle propel members. This is not applicable to the in tandem arrangement as in FIG. 2 because it has been arranged to operate properly. To correct the problem, the vertical plane of the triangle for the in dual structure of FIG. 9 must be set about 5 degrees out of parallel with a vertical plane parallel to nozzle propelling members 11 so as to have a normal neutral, counter rotation and cleaning posture. This arrangement of the handle plane to the nozzle plane remains substantially parallel but does permit the usual up to 5 degree left twist of handle 12 hand grip to cause a differential change in friction of the two nozzle propelling members 11 on the work surface with 11C having the greater friction. From the neutral friction posture of the two members 11, a right twist of the handle lifts the toe causing a differential in weight distribution of the two members 11 with the one at the heel of the nozzle 11D now propelling nozzle 10 to the right. Thus, the problem was solved. An urging of the handle upwardly also results in a left sweep and an urging downwardly from the neutral posture results in a right sweep. This was found to be unnatural movements.

Figure 15:
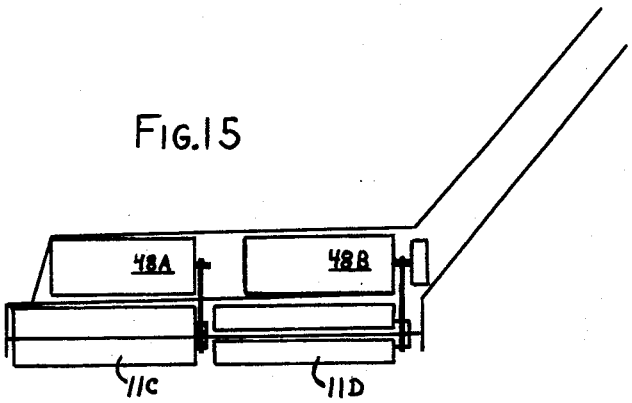
FIG. 15 is a schematic side view of an alternative form of the structure of FIG. 9 with twin motors mounted above the nozzle.

As a result, the structure of FIG. 15 was made to use the natural urging of the handle by changing the motor speeds as will be seen. It is also subject to the same raising and lowering urges of the handle which the operator quickly learns to control. The change in motor speeds resulted in smoother sweeps for the beginner but lost the desired low profile front portion of nozzle 10. The low profile was again obtained by setting the two motors in tandem as in FIG. 12 to drive the two members 11C and D of FIG. 15. Thus, motor 48A is turned around and located alongside 48B to drive 11C. The wiring on 48A was changed to rotate it in the same direction as 48B for opposite roll rotation.

FIG. 10 is a front end view of FIG. 9 showing side brushes 24, as in FIG. 4. They are required for fast sweeps when nozzle 10 is tilted beyond 5 degrees.

FIG. 11 is a schematic side view of an alternative handle of the invention in FIG. 2, which positions handle 12B and debris container 25 above certain furniture. It also shows use of alternative gear transmission of the conventional kitchen mixer worm gear type. This handle shape readily adapts to the flexible remoting shaft 33 in FIG. 8.

FIG. 12 is a schematic rear end view of a nozzle 10 illustrating structure embodying the two nozzle propelling members of FIGS. 2 or 5 being individually driven by an electric motor. The twin motors 48 are located, side by side, above nozzle 10.

Nozzle 10 in this invention generally may pertain to the housing about motors 48 as well as the portion substantially covering the nozzle propelling members 11. Nozzle 10 also forms portions of the debris intake.

FIG. 13 has been included to better show the structure of FIG. 12 in a side view. For example, motor 48A drives nozzle propelling member 11A by belt pulley 50A, through belt 49A and pulley 51A as seen in FIG. 12. Handle 12B is curved so as to carry its attached members much as in FIG. 11. Motor 48B drives member 11B in like manner.

Handle 12B, of FIGS. 12 and 13 is rigidly fixed to nozzle 10 unless it is hinged and support wheel 17 is installed as pertains to the foregoing structure of the invention. Nozzle propelling members 11A and B are responsive to handle urging in a general manner as in the foregoing structures, such as when handle 12B may be twisted a few degrees to tilt nozzle 10. Nozzle propelling members 11A and B are also responsive to differential speeds causing differential friction on the work surface when driven at different speeds by their respective drive motors 48A, 48B. These motors are in turn responsive to natural urging of handle 12B by the operator activating electrical switches on the handle grip. The switches are of types conventionally designed. There are several simple methods available to change speeds of motors. Handle 12B has a hand grip 12C at operator end rotatable to the handle for some ten degrees either side of neutral motor speeds. A hardware type light dimmer was mounted on the handle. Its rotary switch was made responsive to a 10 degree left twist of the rotatable hand grip to reduce motor 48B speed about 20 percent. A second like switch was mounted close by in the opposite direction to reduce the speed of motor 48A with a twist up to 10 degrees. Both switches were spring loaded to remain in full speed position when not being slowed by the handle grip. The switches may be located in any conventional location so long as they are satisfactorily activated in fewer degrees of twist than those tested. This method of obtaining differential friction for sweeping is a very stable and easy to operate method, somewhat easier than the foregoing method of tilting the nozzle. Provision for locking the hand grip in neutral makes both methods available. An alternative to the nozzle location of motors 48A and B maybe provided by the use of rigid or flexible remoting shafts as by FIGS. 5 and 8.

FIG. 13 is a schematic side view of FIG. 12 with suction pumps 15 added when not supplied downstream by a conventional method. The rotatable type hand grip 12C is shown.

FIG. 14 shows the rear end of a structure illustrating a low profile embodiment wherein the two motors 48A and B of FIG. 12 are re-located to lie between the nozzle propelling members 11 with the axis of all four members substantially parallel and lying in a plane. Nozzle 10 has nozzle baffle 10A defining a nozzle surface disposed between the lower portions of nozzle propelling members 11A and B, substantially in the same plane of the lower margins nozzle 10 and extending throughout the length of members 11A and B. Baffle 10A encloses the bottom portions of motor 48A and B, and provides a low friction surface when in contact with the work surface and joins debris duct 20C wall portions 26A. Debris duct 20C is formed about member 11A and 11B and may be joined to form one duct downstream in a conventional manner.

FIG. 15 illustrates an alternative form of FIG. 9 wherein the two nozzle propelling members 11C and 11D are driven by individual motors 48A and 48B by belt reduction transmissions as in FIGS. 12, 13 and 14. The purpose and technique was described in the foregoing Figs.

FIG. 16 is a schematic bottom view of an alternative method of self-propulsion of the invention wherein brush rolls 11E and 11F may be the novel brush rolls 11A and 11B of the invention or conventional brush rolls of the art which may be spaced and supported in a conventional manner relative a work surface. These brush rolls do not function as nozzle propelling members in this description. This does not mean they cannot be so employed.

The structure of FIG. 16 is preferred to be used on work surfaces for cleaning and dusting. On hard surfaces, handle 12 may be urged into natural directions without self-propulsion when both brush rolls 11E and F rotate at the same speeds and in opposite directions and when the nozzle supporting wheels free-wheels as follows. The brush rolls are individually driven by two motors 48A and B as in the foregoing illustrations. Self-propulsion is preferred as when operating on soft work surfaces but is not required on hard surfaces. As in the foregoing illustrations, the nozzle here is also propelled by the nozzle weight supporting and propelling members. In this embodiment, the two opposite rotating nozzle propelling members are coaxial with the brush rolls and are of wheel type similar in shape to support wheels 17 and 18 in FIG. 2, but here designated as nozzle propelling members 53A and 53B on the front of nozzle 10, and 52A and 52B on the rear of nozzle 10. As the wheels are capable of free-wheeling, nozzle 10 may be urged into side sweeps by wrist bending.

Nozzle propelling members 53 and 52, paired at toe and heel as illustrated, may be fixed to their respective shafts 54A and 54B so as to rotate at all times with their respective brush rolls and in this connection become responsive to handle urging for a second mode of side sweep operation. In this mode, twisting handle 12 results in differential friction of the two opposite rotating propelling members on the work surface causing a side sweep. This self propulsion is similar to the action of the embodiment in FIG. 2, both embodiments having smooth surfaced nozzle propelling members operating on soft work surfaces like most carpeting provides but one being brush rolls and the other here as wheels.

A third mode of performing side sweeps is provided when nozzle propelling members 52 and 53 free-wheel, in respect to shafts 54A and 54B, until clutched by clutch 56A or 56B to rotate and propelling nozzle 10 in a sweep. In example, in FIG. 17, shaft 54A is rotated by motor 48A. Shaft 54A drives brush roll 11E, which is not load bearing. When free-wheeling nozzle propelling member 52A is clutched by wedge roller 55A, moving down against clutch disk 56A so as to press 56A against member 52A, 52A commences to rotate on the work surface with greater friction than unclutched nozzle supporting member 52B of FIG. 16. This differential friction results in a sweep to the left when the direction of rotation of shaft 54A corresponds. The speed of rotation of 52A may or may not reach shaft 54A speed, depending on the work surface texture. Clutch elements 56A and 55A may be of similar design to any of the many friction clutches in clutch art. The mounting of 55A, so as to be responsive to handle 12 twisting, requires some form of the many types of available linkage with handle 12. Front nozzle supporting wheels 53A and 53B may be located within or exterior to nozzle 10 with any of the methods cited above for their companion wheel type nozzle propelling members 52A and 52B. There may be need for propelling members 52A and 52B to be located in nozzle 10.

A fourth mode of performing side sweeps is wherein the nozzle propelling members 52A and B are fixed to their respective driving shafts and are responsive to handle urging through variations of the speeds of motors 48A and 48B as described for the embodiment in FIG. 12.

The foregoing disclosure of the preferred embodiments is illustrative of the broad inventive concepts comprehended by the invention.

I claim:

1. Brushing apparatus, comprising:

a nozzle;

at least one brush;

means rotatably connected to the nozzle, comprising cylindrical members with axes substantially parallel to a work surface, for propelling the nozzle over the work surface and for mounting the at least one brush;

the rotatable members including at least one brush roll for mounting the at least one brush and further including at least one wheel type propelling member coaxial to the at least one brush roll;

power means for rotating the rotatable means;

control means for controlling the nozzle and the rotatable means over the work surface including means forming an elongated handle on the nozzle with its longitudinal axis aligned with a plane perpendicular to the work surface, and the handle axis further aligned about 45 degrees to the axes of the rotatable means, and the plane aligned substantially parallel to the axes of the rotatable means; and, the control means responsive to operator urging so as to effect powered side sweeps of the nozzle over the work surface in directions perpendicular to the axes of the rotatable means and to the plane of the elongated handle means.

2. The invention of claim 1, wherein; the rotatable members include twin brush rolls with the at least one brush including two brushes one being mounted on each of the twin brush rolls, and the at least one wheel type propelling member includes two wheel type propelling members one being coaxial to each brush roll.

3. The invention of claim 2, including; vacuum means for providing suction and debris removal.

4. The invention of claim 3, wherein; the power means includes at least one motor located approximate the nozzle, the twin brush rolls are in tandem, the elongated handle is hinged to the nozzle, the rotatable means includes at least two wheel type propelling members, and the power means further includes clutch means operatively associated with the control means for clutch rotation of the propelling members at variable speeds for the powered side sweeps.

5. Brushing apparatus, comprising:
a nozzle;
at least one brush;
means rotatably connected to the nozzle, comprising cylindrical members with axes substantially parallel to a work surface, for propelling the nozzle over the work surface and for mounting the at least one brush;
power means for rotating the rotatable means;
control means for controlling the nozzle and the rotatable means over the work surface including means forming an elongated handle on the nozzle with its longitudinal axis aligned with a plane perpendicular to the work surface, the handle axis further aligned about 45 degrees to the axes of the rotatable means, and the plane aligned substantially parallel to the axes to the rotatable means;
the control means responsive to operator urging so as to effect powered side sweeps of the nozzle over the work surface in directions perpendicular to the axes of the rotatable means and to the plane of the elongated handle;
the rotatable members including twin brush rolls with the at least one brush including two brushes, one being mounted on each of the twin brush rolls;
vacuum means for providing suction and debris removal; and,
the power means including at least one motor on the nozzle, the twin brush rolls being in tandem, the elongated handle is hinged to the nozzle, the rotatable means further including at least one wheel type propelling member fixed to rotate with each of the brush rolls, and the power means further includes electrical switch means operatively associated with the control means for differential speed control of the rotatable means.

6. Brushing apparatus, comprising:
a nozzle;
at least one brush;
rotatable means for supporting and propelling the nozzle over a work surface and for mounting the at least one brush, rotatably connected to the nozzle and comprising cylindrical members with axes substantially parallel to the work surface;
the rotatable members include at least one brush roll for mounting the at least one brush and further includes at least one wheel type propelling member coaxial to the at least one brush roll;
power means for rotating the rotatable means;
an elongated handle member on the nozzle, having its longitudinal axis disposed in alignment with a plane perpendicular to the work surface and at about 45 degrees to the axes of the rotatable members and the plane aligned substantially parallel to the axes of the rotatable members, for control of the nozzle and the rotatable means; and,
the nozzle and the rotatable means responsive to operator urging of the elongated handle members for self propulsion in path directions over the work surface perpendicular to the axes of the rotatable member and plane of the elongated handle member.

7. The invention of claim 6, wherein; the at least one brush roll includes twin brush rolls with the at least one brush including two brushes one being on each of the brush rolls, and the at least one wheel type propelling member includes two wheeltype propelling members one being coaxial to each brush roll.

8. The invention of claim 7, including; vacuum means for providing suction and debris removal and the brush rolls rotatable in opposite directions in respect to each other.

9. The invention of claim 8, wherein; the power means includes at least one motor located approximate the nozzle, the twin brush rolls are in tandem, the elongated handle members is hinged to the nozzle, and the power means further includes clutch means operatively associated with the elongated handle members for clutch rotation of the wheel type propelling members.

10. The invention of claim 7, wherein; the power means includes at least one motor on the nozzle, the twin brush rolls are in tandem and rotatable in opposite directions, the elongated handle means is hinged to the nozzle, and the elongated handle means includes hand grip means on the elongated handle means rotatable to the elongated handle means and operatively associated with the power means for rotation of the wheel type propelling members at variable speeds for the self propulsion.

11. Brushing apparatus, comprising:
a nozzle;
at least one brush;
rotatable means for supporting and propelling the nozzle over a work surface and for mounting the at least one brush, rotatably connected to the nozzle and comprising cylindrical members with axes substantially parallel to the work surface;
power means for rotating the rotatable means;
an elongated handle member on the nozzle, having its axis disposed in alignment with a plane perpendicular to the work surface and at about 45 degrees to the axes of the rotatable members and the plane aligned substantially parallel to the axes of the rotatable members, for control of the nozzle and the rotatable means;
the nozzle and the rotatable means responsive to operator urging of the elongated handle member for self propulsion in path directions over the work surface perpendicular to the axes of the rotatable members and plane of the elongated handle member;
the rotatable members includes twin brush rolls with the at least one brush including two brushes one being mounted on each of the brush rolls;
vacuum means for providing suction and debris removal and the brush rolls rotatable in opposite directions in respect to each other; and,
the power means includes at least one motor on the nozzle, the twin brush rolls are in tandem, the elongated handle member is hinged to the nozzle, the rotatable members includes at least one wheel type propelling member fixed to rotate with each of the brush rolls, and the power means further includes electrical switch means operatively associated with the elongated handle member for differential speed control of the rotatable means.

12. Brushing apparatus, comprising:
a nozzle;
at least one brush;
means rotatably connected to the nozzle comprising cylindrical members with axes substantially parallel to a work surface, for propelling the nozzle over the work surface and for mounting the at least one brush;
power means for rotating the rotatable means;

control means for controlling the nozzle and the rotatable means over the work surface including means forming an elongated handle member on the nozzle with its longitudinal axis aligned with a plane perpendicular to the work surface, the handle axis further aligned about 45 degrees to the axes of the rotatable members, and the plane aligned substantially parallel to the axes of the rotatable members;

the control means responsive to operator urging so as to effect powered side sweeps of the nozzle over the work surface in directions perpendicular to the axes of the rotatable members and to the plane of the elongated handle member; and, the power means includes at least one motor located approximate the nozzle, the rotatable members includes twin brush rolls in tandem and rotatable in opposite directions, the at least one brush including two brushes one being mounted on each of the twin brush rolls, and the power means further includes belt means for belt transmission of power to rotate the rotatable members.

13. The invention of claim 12 wherein; the elongated handle member is hinged to the nozzle, the rotatable members including at least one wheel type propelling member coaxial with each of the twin brush rolls, and the control means includes hand grip means on the elongated handle member rotatable with respect to the elongated handle member and operatively associated with the rotatable members to vary the speed of the at least one wheel type propelling member for enabling the operator urging.

14. Brushing apparatus, comprising:

a nozzle;

at least one brush;

rotatable means for supporting and propelling the nozzle over a work surface and for mounting the at least one brush, rotatably connected to the nozzle and comprising cylindrical members with axes substantially parallel to the work surface;

power means for rotating the rotatable means;

an elongated handle member on the nozzle, having its longitudinal axis disposed in alignment with a plane perpendicular to the work surface and at about 45 degrees to the axes of the rotatable members and the plane aligned substantially parallel to the axes of the rotatable members, for control of the nozzle and the rotatable means;

the nozzle and the rotatable means responsive to operator urging of the elongated handle members for self propulsion in path directions over the work surface perpendicular to the axes of the rotatable member and plane of the elongated handle member;

the rotatable members includes twin brush rolls with the at least one brush including two brushes one being mounted on each of the brush rolls;

the power means includes at least one motor on the nozzle, and the twin brush rolls are in tandem and rotatable in opposite directions;

the elongated handle member is hinged to the nozzle, the rotatable members including at least one wheel type propelling member coaxial with each brush roll, and the elongated handle member includes hand grip means on the elongated handle member rotatable with respect to the elongated handle member and operatively associated with the hand grip rotatable means for clutch rotation of the wheel type propelling members at variable speeds for self propulsion.

* * * * *